United States Patent [19]

Schmidt

[11] 4,112,379

[45] Sep. 5, 1978

[54] JAM DETECTOR

[75] Inventor: Stephen R. Schmidt, Chicago, Ill.

[73] Assignee: Copar Corporation, Oak Lawn, Ill.

[21] Appl. No.: 799,217

[22] Filed: May 23, 1977

[51] Int. Cl.[2] ..... B65H 7/04

[52] U.S. Cl. ..... 328/5; 340/673; 250/557

[58] Field of Search ..... 328/5; 340/259; 250/557

[56] References Cited

U.S. PATENT DOCUMENTS

| | | | |
|---|---|---|---|
| 3,532,990 | 10/1970 | Kasper | 328/5 |
| 3,737,159 | 6/1973 | Washio et al. | 340/259 X |
| 3,778,629 | 12/1973 | Terryn | 250/557 |
| 3,878,540 | 4/1975 | Kawai | 340/259 |
| 3,944,933 | 3/1976 | Gallet | 328/5 |
| 4,066,969 | 1/1978 | Pearce et al. | 328/5 |

*Primary Examiner*—John S. Heyman
*Attorney, Agent, or Firm*—Kinzer, Plyer, Dorn & McEachran

[57] ABSTRACT

A system for detecting a jam condition in a series of sequentially moving members which are passing a plurality of stations. The system finds particular application in the production of corrugated board or the like in which at the first station there may be a slitting or slotting or printing drum which is performing an operation on a series of moving corrugated board members. There are detection means at each station and successive signals from one station indicating the presence of a member at that station without a resetting signal from the next sequential station will provide a signal indicative of a jam condition. There are means to prevent a false indication of a jam which can be caused by the absence of a member at the first station in the system.

10 Claims, 2 Drawing Figures

JAM DETECTOR

SUMMARY OF THE INVENTION

The present invention relates to jam detectors for use with machines processing corrugated board or the like.

One purpose of the invention is an improvement on the jam detection system of U.S. Pat. No. 3,944,933.

Another purpose of the invention is a means for preventing false indication of jam conditions in a system of the type described.

Another purpose is a jam detection system in which the stations for detecting jam conditions may be spaced apart a substantial distance and in which there may be a number of corrugated boards moving between each of said stations at any one time.

Another purpose is a jam detection system in which the absence of a blank or the skipping of a blank at the input of the system will not cause a false jam indication.

Another purpose is a jam detection system of the type described in which sequential storage means, for example a shift register, is used to provide an instantaneous position indication of all moving members and the absence thereof in the system.

Other purposes will appear in the ensuing specification, drawings and claims.

BRIEF DESCRIPTION OF THE DRAWINGS

The invention is illustrated diagrammatically in the following drawings wherein.

DESCRIPTION OF THE PREFERRED EMBODIMENT

Figure 1:
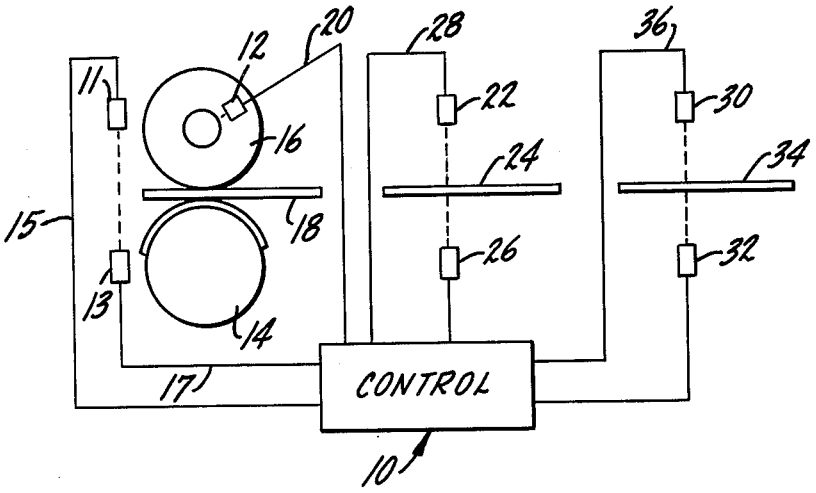
FIG. 1 is a diagrammatic illustration of a machine of the type described.

In FIG. 1 the control circuit is illustrated diagrammatically at 10 and is connected to a detector 12 positioned adjacent a pair of slotting drums 14 and 16 which rotate in the conventional manner to slot a blank 18. The blank may be corrugated board or the like, although the invention should not be limited to this application. In like manner, the drums 14 and 16 may be printing drums rather than slotting drums. In any event, detector 12 which, as shown herein, is a magnetic pickup, but could be a proximity device, photoelectric device or the like, provides a signal each time a blank is processed by drums 14 and 16. Detector 12 is connected by a line 20 to control circuit 10.

Positioned upstream of the slotting drums 14 and 16 is a photocell 11 in alignment with a light source 13, both of which are connected to control circuit 10 by lines 15 and 17, respectively. Whenever a blank is about to be fed between the slotting drums, the light beam between source 13 and cell 11 will be broken and a signal will be sent to control circuit 10.

The drums described above may be the first station in the particular series of stations controlled by circuit 10, with the second station having a photoelectric cell 22 on one side of a blank 24 and a light source 26 on the opposite side. Thus, whenever the light beam between source 26 and cell 22 is broken, indicating the presence of a blank, a signal will be sent via line 28 to control 10.

In like manner, there may be a third station utilizing a photoelectric cell 30 and a light source 32 on opposite sides of a moving blank 34 so as to provide a control signal via line 36 to circuit 10.

The blanks are shown in a diagrammatic manner and it should be understood that conventionally there will be a conveyor or some other belt-type device which will move the blanks from station to station. There may be operations performed at each station, or at only the first station. In like manner, the invention should not be limited to any particular type of detection means at any particular station, although a magnetic pickup at the first station and photoelectric pickups at succeeding stations and prior to the slotting drums have been found to provide a satisfactory method of operation.

The various stations will normally be spaced a substantial distance apart so that there may be several blanks continuously moving between stations.

Figure 2:
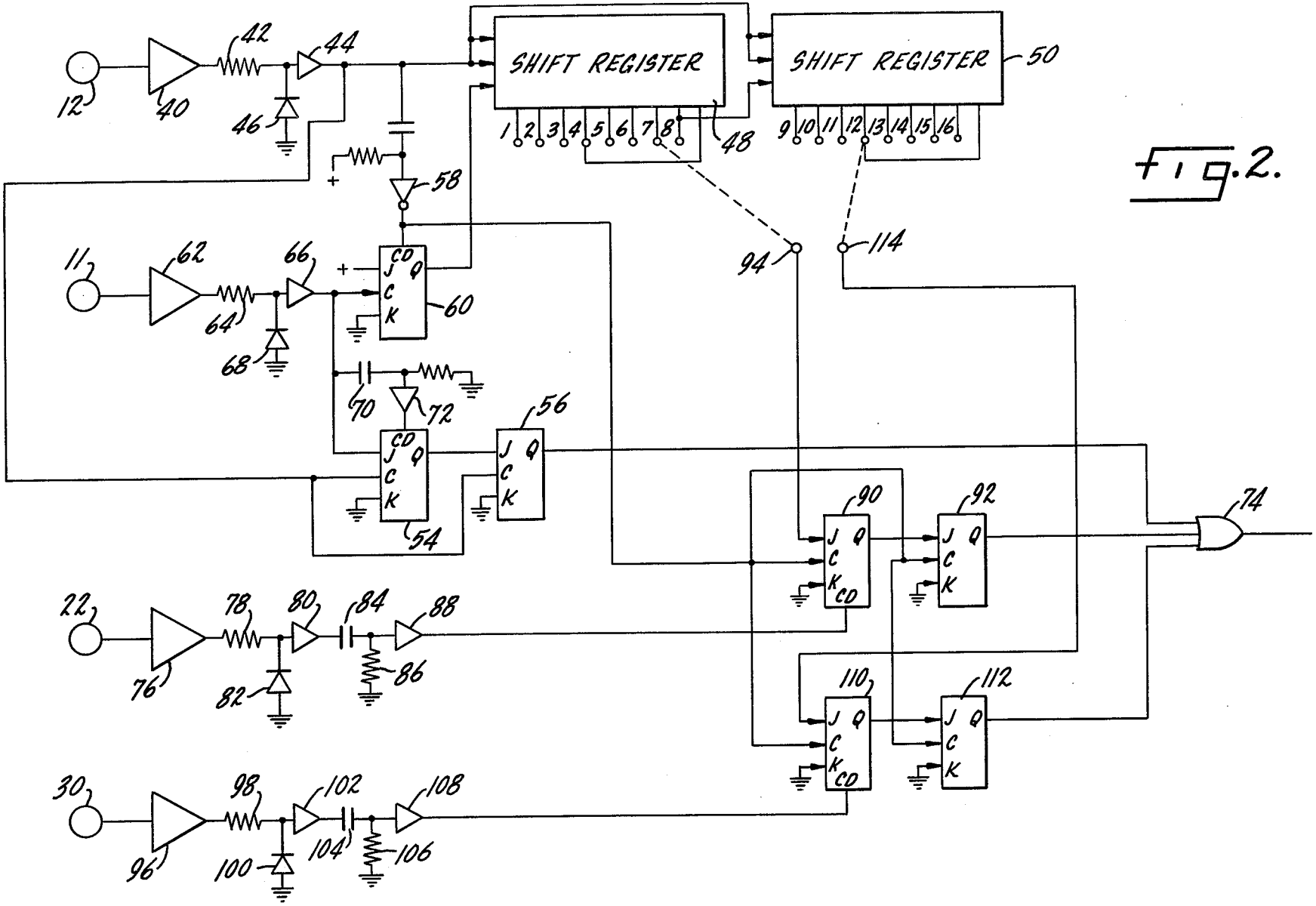
FIG. 2 is a block diagram of the control circuit.

In FIG. 2, the diagrammatically illustrated magnetic pickup device 12 is connected through an operational amplifier 40 and a resistor 42 to a buffer amplifier 44. A diode 46 is connected to the input side of buffer 44 and to ground to protect the buffer against negative voltages. The output of buffer amplifier 44 is connected to a first eight-bit static shift register 48 and to a second eight-bit static shift register 50. In addition, a buffer 44 is connected via line 52 to the C input of a JK flip-flop 54 and to the C input of a second JK flip-flop 56. Buffer 44 is also connected through an inverting amplifier 58 to the CD input of a JK flip-flop 60.

Photoelectric cell 11 is connected through an operational amplifier 62 to a resistor 64 and to a buffer amplifier 66. A clamping diode 68 is connected in the same manner as diode 46. The output of buffer amplifier 66 is connected to the C input of JK flip-flop 60 and to the J input of flip-flop 54. The output of buffer 66 is also connected through a capacitor 70 to a buffer amplifier 72 which provides an input to the CD terminal of flip-flop 54. The Q output of flip-flop 54 is connected to the J input of flip-flop 56 and the Q output of flip-flop 56 is connected to an OR gate or jam indicating gate 74.

Photocell 22 is connected to an operational amplifier 76 which in turn is connected through a resistor 78 and a clamping diode 82 to a buffer amplifier 80. The output of buffer 80 is connected through a capacitor 84 and resistor 86 to a second buffer 88. Buffer 88 is connected to the CD input of a JK flip-flop 90. The C input of flip-flop 90 is connected to the output of inverter 58 and the J input of flip-flop 90 is connected to a patch terminal 94. The Q output of flip-flop 90 is connected to the J input of flip-flop 92 whose Q output is connected to OR gate 74. The C input of flip-flip 92 is also connected to the output of inverter 58.

Photocell 30 is connected through similar circuitry, i.e. an operational amplifier 96, resistor 98, clamping diode 100, buffer amplifier 102, capacitor 104, resistor 106 and a second buffer amplifier 108, to the CD input of a JK flip-flop 110. The Q output of flip-flop 110 is connected to the J input of a second flip-flop 112 whose Q output is connected to OR gate 74. The C inputs of flip-flops 110 and 112 are connected to the output of inverter 58 and the J input of flip-flop 110 is connected to a patch terminal 114.

In a slotting operation, and in similar operations in which work may be done on a moving member at one or more stations, it is necessary to protect against a jam at any point in the entire line of moving members. To avoid false indications of a jam there must be an indication of when a member is not being fed into the line, i.e. when for one reason or another a blank is not being processed by the slotting drums in the specific example disclosed herein. Otherwise, it is possible for there to be an indication of a jam condition, when in fact it is nothing more than the absence of a blank to be processed.

considering photocell 11 and magnetic detector 12, the photocell indicates when a blank is being fed into the machine and the magnetic pickup indicates when a blank is being processed by the machine. Whenever photocell 11 receives no light, indicative of a blank being fed into the slotting drums, a positive signal will be applied to the J input of flip-flop 54. The transition from a negative output to a positive output at buffer amplifier 66 will provide a momentary positive going voltage for buffer 42 which will effectively reset flip-flop 54 and this will happen prior to the positive input at the J terminal of this flip-flop. A subsequent signal from magnetic detector 12, processed through the described amplifier, will apply a signal to the C input of flip-flop 54 which will cause the flip-flop to change condition and thereby provide a positive input to the J terminal of flip-flop 56. The next blank being fed into the slotting drums will cause a repeat of the signals described in connection with the output from photocell 11, having the effect of resetting flip-flop 54 prior to the time that the positive signal is applied to the J input from buffer 66. Thus, the J input of flip-flop 56 returns to a negative condition prior to the time that the next signal from magnetic pickup 12 is applied to the C terminals of flip-flops 54 and 56. If there is no jam condition, flip-flop 56 will never have an output at its Q terminal, as this can only be brought about by positive signals at its J and C input terminals. Flip-flop 54 will always return its Q output to a negative condition prior to the next signal from magnetic detector 12. There will thus be no signal to the jam OR gate 74 as long as the above-described sequence of operations at the slotting drums takes place.

If there is a jam which would be evidenced by the absence of a reset signal from buffer 72 to the CD input of flip-flop 54, the J input of flip-flop 56 would remain positive and thus the next signal from magnetic detector 12 applied to the C input of flip-flop 56 would cause an output on its Q terminal to the jam OR gate 74. Flip-flop 54 must be reset by a signal from photocell 11 evidencing that a new blank has been fed into the slotting drums or else there will be a jam indication.

There may be occasions when a blank will be skipped, or a blank will not be fed in sequence behind the preceding blank. When this occurs, there will be no input to the J terminal of flip-flop 54 and thus flip-flop 54 cannot provide an output on its Q terminal.

When a control system of the type described is initially installed, the machine is run and it is filled with blanks, and once there are blanks at all stations along the conveyor, the machine is stopped. If under such circumstances, and as an example, the seventh blank is underneath photodetector 22, then patch terminal 94 is connected to pin 7 of shift register 48. If the twelfth blank is under photodetector 30, then patch terminal 114 is connected to the fourth pin of shift register 50 which signifies the twelfth position, since combined the two shift registers have 10 pins or positions.

Photodetector 11, each time it sees a blank, provides an input on the C terminal of flip-flop 60. The J terminal is always positive or high, and thus every time a blank is fed into the slotting drums, a signal will be provided at the Q output of flip-flop 60 to the input of shift register 48 which will result in the first station in the shift register going high. A signal from magnetic detector 12 will cause the signal in the first station in the shift register to be shifted to the second, with successive signals from detector 12 moving information stored in each station of the shift register successively down the register and into and through the second shift register. Also, flip-flop 60 will be reset by a signal from inverter amplifier 58 each time a shift signal is applied to the register. Thus, every time a blank is fed there will be a high signal fed into the shift register. If a blank is skipped, there will be an absence of a signal and this absence of a signal will also be shifted down through the various stations in the shift register. Thus, the shift registers give an instantaneous indication of any vacant spaces in the constant series of moving blanks which are being carried by the conveyor.

When a high signal is shifted to pin 7 of shift register 48, the J terminal of flip-flop 90 will go high. A simultaneous signal at the C terminal provided by magnetic detector 12 will cause the Q terminal to go high, causing the J terminal of flip-flop 92 to go high. If a blank then does in fact pass detector 22, as it should if there is no jam, flip-flop 90 will be reset by a signal from buffer 88 prior to the time that the next shift signal is received from inverter 58. This will prevent flip-flop 92 from providing an output at its Q terminal which is indicative of a jam. If no signal is provided by detector 22 at such time, indicating that a blank did not arrive at that station at the prescribed time, then the next shift signal will in fact cause flip-flop 92 to have an output at its Q terminal indicative of a jam condition.

The operation of photodetector 30 is the same as described above. In this case, however, the device is determining whether or not there is a jam in front of what might be called the twelfth station or a location which is separated from the input by 12 blanks. A blank must appear under photodetector 30 to reset flip-flop 110 prior to the time of the next shift signal in order to prevent a jam indication at the output of flip-flop 112.

The present invention is specifically designed as a modification on the jam detection circuit shown in U.S. Pat. No. 3,944,933 assigned to the assignee of the present application. As indicated above, the present invention takes into account those situations in which there is not a jam but only an absence of a blank at the input.

Although the invention has been described in connection with box blanks which are slotted or printed, the invention has substantially wider application and finds utility in any situation in which a series of members are moving on a conveyor or moving in sequence from one station to another and in which work conventionally will be performed on the member at one or more stations.

Whereas the preferred form of the invention has been shown and described herein, it should be realized that there may be many modifications, substitutions and alterations thereto.

The embodiments of the invention in which an exclusive property or privilege is claimed are defined as follows:

1. A system for use in detecting jams in a series of members which are sequentially moving through predetermined spaced fixed stations, there being an operation performed on said members in at least one of said stations, said system including detection means at each station providing an output signal indicating the presence of a member at the station, a first circuit means having an input connected to the detection means at one of said stations and a reset input connected to the detection means at another of said stations, a second circuit means having an input connected to the detection means at said one of said stations and an output providing a signal indicating a jam condition, said first circuit means having an output connected to an input of said second circuit means, with simultaneous inputs at said second circuit means causing an output indicative of a jam condition;

the improvement comprising means for indicating the absence of a member at said one of said stations, and means responsive to said means for indicating the absence of a member for preventing a false jam indication.

2. The system of claim 1 further characterized in that the means for indicating the absence of a member at said one of said stations includes a second detector at said one station, said second detector being positioned to indicate if a member is or is not proceeding toward said first detector.

3. The system of claim 2 further characterized in that said means for preventing a false jam indication include shiftable storage means for providing an indication of the presence or absence of a member at any position in said system.

4. The system of claim 3 further characterized in that said shiftable storage means includes a shift register connected to an input of said first circuit means.

5. A system for use in detecting jams in a series of members which are sequentially moving through predetermined spaced fixed stations, there being an operation performed on said members in at least one of said stations, said system including detection means at a plurality of said stations providing an output signal indicating the presence of a member at the station, a first bistable circuit having an input connected to the detection means at the first station and a reset input connected to the detection means at a subsequent station, a second bistable circuit having an input connected to the detection means at said first station and an output providing a signal indicating a jam condition, said first bistable circuit having an output connected to the input of said second bistable circuit, with simultaneous inputs at said second bistable circuit causing an output indicative of a jam condition, the improvement comprising means for indicating the absence of a member at said first station and means responsive to said means for indicating the absence of a member for preventing a false jam indication.

6. The system of claim 5 further characterized in that the means for indicating the absence of a member at the first station include second detection means at said first station positioned upstream of said first detection means.

7. The system of claim 6 further characterized in that the means responsive to said means for indicating the absence of a member for preventing a false jam indication include shiftable storage means connected to the first and second detection means at said first station.

8. The system of claim 7 further characterized in that said shiftable storage means is connected to one input of said first bistable circuit.

9. The system of claim 6 further characterized by and including bistable circuit means connected to the first and second detectors at said first station, the output of said bistable circuit means being arranged to give an indication of a jam condition at said first station.

10. The system of claim 7 further characterized by and including a third bistable circuit having an input connected to said second detection means and an output connected to said shiftable storage means to indicate the absence of a member in front of said first station.

* * * * *